US012584184B2

(12) United States Patent
Kammerhofer et al.

(10) Patent No.: US 12,584,184 B2
(45) Date of Patent: Mar. 24, 2026

(54) TRACK PART AND METHOD FOR PRODUCING A TRACK PART

(71) Applicant: VOESTALPINE SCHIENEN GMBH, Leoben (AT)

(72) Inventors: Christoph Kammerhofer, Leoben (AT); Hans Peter Brantner, Leoben (AT)

(73) Assignee: VOESTALPINE SCHIENEN GMBH, Leoben (AT)

( * ) Notice: Subject to any disclaimer, the term of this patent is extended or adjusted under 35 U.S.C. 154(b) by 141 days.

(21) Appl. No.: 18/343,336

(22) Filed: Jun. 28, 2023

(65) Prior Publication Data

US 2023/0416858 A1 Dec. 28, 2023

Related U.S. Application Data

(63) Continuation of application No. 16/616,663, filed as application No. PCT/AT2018/000049 on May 29, 2018, now abandoned.

(30) Foreign Application Priority Data

Jun. 7, 2017 (AT) ..... A 240/2017

(51) Int. Cl.

| | |
|---|---|
| ***C21D 9/04*** | (2006.01) |
| ***C21D 1/20*** | (2006.01) |
| ***C21D 1/63*** | (2006.01) |
| ***C21D 6/00*** | (2006.01) |
| ***C22C 38/00*** | (2006.01) |

(Continued)

(52) U.S. Cl.

CPC ..... *C21D 9/04* (2013.01); *C21D 1/20* (2013.01); *C21D 1/63* (2013.01); *C21D 6/002* (2013.01); *C21D 6/005* (2013.01); *C21D 6/008* (2013.01); *C22C 38/001* (2013.01); *C22C 38/002* (2013.01); *C22C 38/02* (2013.01); *C22C 38/06* (2013.01); *C22C 38/22* (2013.01); *C22C 38/38* (2013.01); *C21D 2211/001* (2013.01);

(Continued)

(58) Field of Classification Search

None

See application file for complete search history.

(56) References Cited

U.S. PATENT DOCUMENTS

2014/0102603 A1 4/2014 Han et al.

FOREIGN PATENT DOCUMENTS

| | | |
|---|---|---|
| AU | 2015204356 A1 | 2/2016 |
| EP | 0358362 A1 | 3/1990 |

(Continued)

OTHER PUBLICATIONS

A.B. Cota, D. B. Santos, Microstructural Characterization of Bainitic Steel Submitted to Torsion Testing and Interrupted Accelerated Cooling, Materials Characterization 44:291-299 (2000). (Year: 2000).*

(Continued)

*Primary Examiner* — Anthony M Liang

(74) *Attorney, Agent, or Firm* — Pillsbury Winthrop Shaw Pittman, LLP

(57) ABSTRACT

In a track part, in particular a low-alloy steel rail for rail vehicles, the steel comprises, in the rail head of the track part, a ferrite portion of 5-15 vol %, an austenite portion of 5-20 vol %, a martensite portion of 5-20 vol %, and a portion of carbide-free bainite of 55-75 vol %.

21 Claims, 2 Drawing Sheets

(51) Int. Cl.

| | |
|---|---|
| ***C22C 38/02*** | (2006.01) |
| ***C22C 38/06*** | (2006.01) |
| ***C22C 38/22*** | (2006.01) |
| ***C22C 38/38*** | (2006.01) |

(52) U.S. Cl.
CPC .. *C21D 2211/002* (2013.01); *C21D 2211/005* (2013.01); *C21D 2211/008* (2013.01)

(56) References Cited

FOREIGN PATENT DOCUMENTS

| | | | | | |
|---|---|---|---|---|---|
| EP | 0612852 | A1 | | 8/1994 | |
| EP | 2103704 | A1 | * | 9/2009 | ..... C21D 6/002 |
| GB | 2297094 | A | | 7/1996 | |
| JP | H08158014 | A | * | 6/1996 | ..... C21D 9/04 |
| JP | 2017057460 | A | * | 3/2017 | |

OTHER PUBLICATIONS

International Search Report PCT/AT2018/000049 dated Jul. 25, 2018.

A.B. Cota, D.B. Santos, Microstructural Characterization of Bainitic Steel Submitted to Torsion Testing and Interrupted Accelerated Cooling, Materials Characterization 44:291-299 (2000).

* cited by examiner

TRACK PART AND METHOD FOR PRODUCING A TRACK PART

CROSS-REFERENCE TO RELATED APPLICATIONS

This application is a continuation of U.S. patent application Ser. No. 16/616,663, filed on Nov. 25, 2019, which is the U.S. National Stage of PCT/AT2018/000049, filed May 29, 2018, which claims priority to Austrian Patent Application No. A 240/2017 filed Jun. 7, 2017, and all contents of each of these applications are incorporated herein by reference in their entireties.

The invention relates to a track part, in particular a low-alloy steel rail for rail vehicles.

The invention further relates to a method for producing a track part from a hot-rolled section.

In recent times, the weight of transported loads and the moving speeds in rail freight traffic have steadily increased in order to enhance the efficiency of rail transport. Railway tracks are, therefore, subject to aggravated operating conditions and, therefore, have to be of higher quality in order to withstand increased loads. Tangible problems are reflected by a strong increase in the wear of, in particular, rails mounted in curves and by the occurrence of damage due to material fatigue primarily encountered on the running edge, which constitutes the main point of contact of a rail with the wheels in a curve. Rolling contact fatigue (RCF) will result. Examples of RCF surface damage, for instance, include head checks, spalling, squats (plastic surface deformations), slip waves and corrugations. Such surface damage results in reduced service lives of the rails, increased noise emissions and operational disturbances. The increased occurrence of defects is additionally accelerated by continuously growing traffic loads. The immediate consequence of such a development is an elevated rail maintenance demand. However, the growing maintenance demand is in contradiction to the ever decreasing maintenance windows. Higher train densities more and more reduce the time intervals at which rails can be serviced.

Although the aforementioned defects can be eliminated at an early stage by grinding, the rail has to be exchanged when heavily damaged. In operation, head checks will occur in the region of the running edge of the curve outer rail in curves with radii of 500 m and more, i.e. where wear starts to play only a minor role. High local surface pressures combined with local slip in the wheel/rail contact, which is caused by differences in the rolling radii, lead to shear stresses on the surface of the rail material, which will occur at every rolling-over process. Cracks are initiated and, in further consequence, cracks will grow along the orientation of the cold-formed layer, as will be observed on longitudinal cuts of affected rails. The crack growth in the first stage takes place almost in parallel with the surface, subsequently extending continuously into the rail interior. When the cracks have reached a critical length, sudden breakdowns and, due to the periodicity of the cracks, breakaways of rail pieces may be caused.

The wear rate occurring parallelly with the crack growth is always smaller both with the classic, completely perlitic rail grades and with the bainitic rail grades, crack growth thus actually dominating.

In the past, several attempts have, therefore, been undertaken to improve both the wear resistance and the resistance to RCF damage in order to increase the life cycle of rails. Among others, this has been realized by the introduction and use of bainitic rail steels.

Bainite is a microstructure that can form during the thermal treatment of carbonaceous steel by isothermal transformation or continuous cooling. Bainite forms at temperatures and cooling rates ranging between those of perlite formation and martensite formation. Unlike with the formation of martensite, shearing processes in the crystal lattice and diffusion processes are coupled in this case, thus providing different transformation mechanisms. Due to the dependency on cooling rates, carbon contents, alloying elements and thus resulting formation temperatures, bainite has no characteristic microstructure. Bainite, like perlite, comprises the phases ferrite and cementite (Fe3C), yet differs from perlite in terms of form, size and distribution. Basically, distinction is made between two main microstructural forms, i.e. upper bainite and lower bainite.

From WO 2014/040093 A1, a method for producing a track part and a rail steel is known, which aims at an improvement of the wear resistance, in particular the avoidance of head checks, and to this end comprises a microstructure with a multi-phase bainite structure having a ferrite content of 5-15% at the rail head. In curves with radii of 500 m or more, the above-identified phenomena will occur, nevertheless.

SUMMARY

The invention, therefore, aims to improve a track part, in particular a rail, to be comprised of a low-alloy steel for cost reasons and for welding reasons to the effect that, even with elevated wheel loads and larger curves, the formation of cracks will be restrained, on the one hand, and the initial crack growth will be clearly delayed while preventing the crack path from entering the interior of the rail, on the other hand. Finally, the track part is to be readily weldable and exhibit similar other material properties, such as a similar electrical conductivity and a similar thermal expansion coefficient, as steels hitherto proven in railway construction.

To solve this object, the invention according to a first aspect provides a track part of the initially defined kind, which is further developed such that the steel comprises, in the rail head of the track part, a ferrite portion of 5-15 vol %, an austenite portion of 5-20 vol %, a martensite portion of 5-20 vol %, and a portion of carbide-free bainite of 55-75 vol %. Carbide-free bainite is comprised of ferrite needles with a high dislocation density without carbide precipitations. The austenitic phase portions in the contact-influenced zone are subject to another deformation mechanism than in the case of conventional carbide-containing rails. Thus, a deformation-induced martensitic phase transformation, the TRIP effect (transformation induced plasticity), followed by a simultaneous increase in hardness and the deformability under plastic stress occur. The increase in hardness, which is equivalent to an elevated deformation resistance, in surface-near regions affects the surrounding carbide-free bainite in such a manner as to restrain shearing of the latter. Directly on the surface of the rail head, martensitically transformed regions are increasingly subject to abrasive wear. The formation of cracks and the initial crack growth will be clearly impeded or slowed down by elevated crack fracture toughness such that, in combination with the naturally occurring wear, no crack growth will actually take place. The track part is thus only subjected to wear so as to enable the precise determination of its duration of use without requiring any further crack formation monitoring.

A particularly good crack resistance will be achieved if the portion of the carbide-free bainite is 60-70 vol %.

The ferrite portion is preferably 8-13 vol %.

It is further provided in a preferred manner that the bainite forms a matrix in which austenite, martensite and ferrite are preferably homogenously distributed. Austenite and martensite are preferably at least partially present in island form, either polygonally or globularly with an average size of several μm, in particular in a range of 1-10 μm. Moreover, austenite is preferably partially present in film form with a thickness of less than 1 μm and a length of several μm. Martensite, in particular, is partially present as pure martensite in a very low or hardly tempered morphology such that carbide precipitations from martensite will hardly occur. The size of the individual martensitic regions is about 5 μm. Ferrite is present partially as grain boundary ferrite and partially as polygonal ferrite. Moreover, the inadvertent grain boundary perlite occurs primarily in the interior of the rail head, because there its occurrence is enabled by a cooling rate that is slightly lower than in the edge zone, which comprises several millimeters.

DETAILED DESCRIPTION

Figure 1:
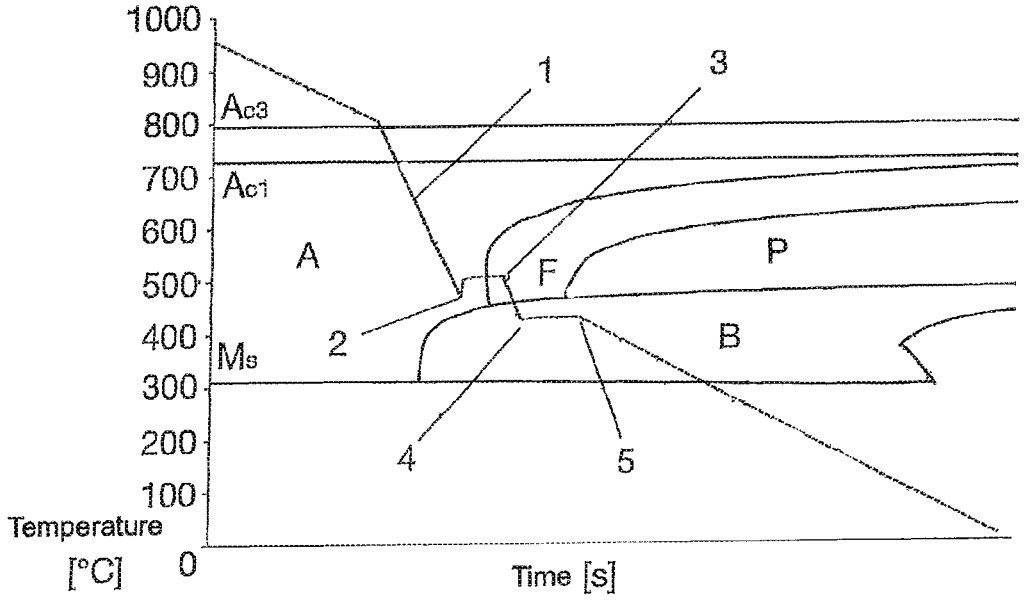
FIG. 1 is a time-temperature transformation diagram of the embodiment of Example 1, wherein the line denoted by 1 represents the cooling course.

As already pointed out above, low-alloy steels are used according to the invention in order to minimize costs and enhance the welding aptitude. In general, the low-alloy steel in the context of the invention preferably comprises as alloying components carbon, silicon, manganese, chromium, molybdenum and optionally vanadium, phosphorus, sulfur, boron, titanium, aluminum and/or nitrogen, and the balance iron.

It is the primary target of the alloyed elements to adjust a carbide-free bainitic microstructure despite a mean carbon content of about 0.3%. This is enabled by purposely alloying silicon, which will subsequently be present in the mixed crystal. The essential characteristic of silicon is its very low solubility in the cementite phase. This results in a strong inhibition and/or temporal delay of cementite formation in the event of a homogenous silicon distribution. Instead, carbon redistribution takes place in those temperature ranges where the cementite formation normally occurs. The reason for this is that the ferrite phase can dissolve considerably less carbon than the austenitic high-temperature phase. Consequently, a carbon transport into the not yet transformed austenite is caused on the ferrite-austenite reaction front, the austenite thus being enriched with carbon and thermally stabilized to an increasing extent. The carbon enrichment in the austenite is stopped when its maximum solubility has been reached. This is graphically described by the so-called TO'-curve, which describes the maximum carbon content in the austenite as a function of the temperature. When the maximum content is reached, the reaction will stop, i.e. no further bainite formation from the carbon-enriched austenite will occur. By further cooling, the thermally unstable austenite areas will transform into more or less high-carbon martensite and optionally self-temper.

It is preferably provided that no alloying component is present in an amount larger than 1.8 wt %.

It is preferably provided that silicon is present in an amount smaller than 1.2 wt %. As already mentioned, silicon is added by alloying in order to prevent the formation of cementite. In doing so, the silicon-carbon ratio is of particular relevance, since partial cementite formation may occur in the event of too small a Si content. On the one hand, carbides per se are not desired in the sought multi-phase microstructure, on the other hand less carbon is available for the stabilization of austenite due to the formation of carbide, which will subsequently facilitate the formation of martensite. This is also undesired. In the prior art, a minimum content of 1.5 wt % silicon is indicated to prevent the formation of cementite at mean carbon contents of around 0.3 wt %. In a preferred configuration, the silicon content is, however, limited to 1.20 wt %, since silicon allows the electrical resistance to strongly increase, thus possibly causing problems with the current recirculation in the track.

Furthermore, it is preferably provided that carbon is present in an amount smaller than 0.6 wt %, preferably smaller than 0.35 wt %. Carbon is that element which influences the martensite starting temperature most. An increasing carbon portion will lead to a decrease of the martensite starting temperature. The martensite starting temperature should not be much higher than 320° C. in order to avoid the occurrence of major martensite portions during the heat treatment and further cooling on the cooling bed. The advantage of a lower carbon portion consists in that the austenite can absorb more carbon and the formation of bainite can occur to a larger extent. Moreover, the risk of an unwanted cementite formation is reduced.

Manganese is, above all, added by alloying in order to counteract the formation of ferrite and perlite during the heat treatment and to adjust mainly carbide-free bainite by increasing the hardenability. Manganese is also an austenite stabilizer and, besides carbon, lowers the martensite starting temperature. From the literature, it is, moreover, known that the T0' curve will shift towards lower carbon contents with increasing manganese contents, which counteracts the continuous formation of carbide-free bainite. For this reason, the maximum Mn content is limited to 1.8%, yet is preferably clearly lower for the above-cited reasons.

Like manganese, chromium also increases the hardenability, yet has a stronger effect than manganese. In addition, chromium causes mixed crystal hardening, which is deliberately utilized. Relatively low chromium contents are sought to prevent the occurrence of chromium carbides, on the one hand, and to facilitate weldability, on the other hand.

Vanadium is a microalloying element that increases hardness without deteriorating toughness. In addition to mixed crystal hardening, the precipitation of very fine particles inducing an increase of the hardness is also caused.

Like manganese and chromium, molybdenum increases hardness. The particularity of molybdenum is that, above all, the diffusion-controlled transformation products, i.e. ferrite and perlite, are shifted towards extended transformation periods, which in the literature is attributed to the solute drag effect. Thereby, the bainite area can be directly targeted even during continuous cooling. Already relatively low molybdenum contents of less than 1/10% are sufficient to achieve this effect. By contrast, molybdenum has a negative effect on the segregation behavior such that the segregated regions are markedly enriched with molybdenum and, in the end, will have a martensitic microstructure. The weldability is also markedly deteriorated by molybdenum. For these two reasons, the molybdenum content is kept as low as possible in order to adjust a predominantly carbide-free microstructure in combination with the heat treatment.

The same effect as molybdenum, i.e. the striking temporal delay of the formation of ferrite and perlite is also exerted by the element boron. The effect of the latter is based on that the atomic boron is hardly soluble in austenite and, therefore, is primarily present on the grain boundaries, thus making the subsequent nucleus formation for ferrite and perlite much more difficult. Already a few ppm of boron will be sufficient for this effect, approximately 30 ppm sufficing for a temporal delay of the ferrite formation by a factor 10. However, if boron nitrides or boron carbonitrides are formed, this positive effect will be lost. For this reason, titanium is additionally alloyed to the steel, since the affinity to nitrogen is clearly higher with titanium than with boron, thus causing the precipitation of titanium carbonitrides. In order to safely prevent the occurrence of boron precipitates, the ratio of titanium to nitrogen, which is always present in the melt at about 50-100 ppm, has to be at least 4:1 so that all of the nitrogen will be bound. A problem resulting therefrom is the precipitation of possibly coarse titanium carbonitrides, which may have adverse effects on the toughness and fatigue properties.

In a preferred manner, a low-alloy steel having the following reference analysis is used:

0.2-0.6 wt-% C
0.9-1.2 wt-% Si
1.2-1.8 wt-% Mn
0.15-0.8 wt-% Cr
0.01-0.15 wt-% Mo, and optionally
0-0.25 wt-% V, in particular 0.01-0.25 wt-% V
0-0.016 wt-% P, in particular 0.01-0.016 wt-% P
0-0.016 wt-% S, in particular 0.01-0.016 wt-% S
balance: iron Particularly good results could be obtained with a low-alloy steel having the following reference analysis:

0.28-0.32 wt-% C
0.98-1.03 wt-% Si
1.7-1.8 wt-% Mn
0.28-0.32 wt-% Cr
0.08-0.13 wt-% Mo, and optionally
0-0.25 wt-% V, in particular 0.01-0.25 wt-% V
0-0.016 wt-% P, in particular 0.01-0.016 wt-% P
0-0.016 wt-% S, in particular 0.01-0.016 wt-% S
balance: iron Preferably, a low-alloy steel having the following reference analysis is used:

0.44-0.52 wt-% C
1.05-1.17 wt-% Si
1.4-1.7 wt-% Mn
0.36-0.80 wt-% Cr
0.01-0.08 wt-% Mo, and optionally
0-0.25 wt-% V, in particular 0.01-0.25 wt-% V
0-0.016 wt-% P, in particular 0.01-0.016 wt-% P
0-0.016 wt-% S, in particular 0.01-0.016 wt-% S
balance: iron A particularly good aptitude for highly stressed track sections is preferably provided if the track part has a tensile strength $R_m$ of 1150-1400 N/mm$^2$ in the head region. Moreover, the track part has a hardness of preferably 320-380 HB in the head region.

According to a second aspect, the invention provides a method for producing the above-described track part, in which the track part is produced from a hot-rolled section, wherein the rail head of the rolled section, immediately after having left the rolling stand, is subjected at rolling heat to controlled cooling, said controlled cooling comprising in a first step cooling at ambient air until reaching a first temperature of 780-830° C., in a second step accelerated cooling to a second temperature of 450-520° C., in a third step holding the second temperature, in a fourth step further accelerated cooling until reaching a third temperature of 420-470° C., in a fifth step holding the third temperature, and in a sixth step cooling to room temperature at ambient air. Said controlled cooling preferably is performed by immersing at least the rail head into a liquid coolant as known per se. Said accelerated cooling in the liquid coolant allows for the selective achievement of the desired temperature ranges in a short time without passing through undesired phase areas.

It is preferably provided that said accelerated cooling in the second step is performed at a cooling rate of 2-5° C./s.

It is preferably provided that the track part is completely immersed into the coolant during the second step.

The step of holding between 450° C.-520° C. (third step) is to primarily provide a temperature compensation between the rail head surface in contact with the coolant and the rail head interior in order to keep stronger reheating in the second holding step (fifth step) low. Moreover, this temperature range offers the following special feature to the steel having the above-identified chemical composition: The extent of ferrite formation, if any, can be influenced by the cooling speed (and hence the time until reaching the temperature range) and by the residence time in this temperature range. In some circumstances, the formation of grain boundary perlite may occur in this temperature range. In order to achieve the above-mentioned effects, it is preferably provided that the third step extends over a period of 10-300 s, preferably 30-60 s.

It is preferably provided that said accelerated cooling in the fourth step is performed at a cooling rate of 2-5° C./s.

It is preferably provided that, during the fourth step, the track part is immersed into the coolant only with the rail head.

The second step of holding between 420° C.-470° C. (fifth step) serves the formation of the carbide-free bainite with a simultaneously running carbon redistribution into the surrounding austenite. In this temperature range, the austenite is primarily present as island type rather than film type. The intensity of the carbon redistribution in this range determines how strongly the austenite can be enriched with carbon and will remain metastable as austenite or transform martensitically during further cooling. For the adjustment of the microstructure, it is, moreover, of particular importance that a temperature not lower than 400° C. will be observed during accelerated cooling (fourth step), since otherwise the formation of the lower bainite step accompanied by fine cementite precipitations will be caused. In order to achieve these effects, it is preferably provided that the third step extends over a period of 50-600 s, preferably 100-270 s.

The adjustment of the two holding steps (third and fifth steps), for instance, can be effected by cooling to the lower limit of the temperature range followed by reheating.

It is preferably provided that the track part is held in a position removed from the coolant during the third and/or fifth steps.

Since the temperature range of the two holding points is a function of the alloying elements of the steel in question and their amounts, the value of the first temperature and the value of the second temperature have to be precisely determined a priori for the respective steel. The temperature of the rail is continuously measured during controlled cooling, wherein the cooling and holding stages are respectively started or terminated when reaching the respective temperature thresholds. Since the surface temperature of the rail may vary over the entire length of the track part, yet cooling is uniformly performed for the whole track part, it is preferably proceeded such that the temperature is detected at a plurality of measuring points distributed over the length of the track part and a mean value of the temperature is formed, which is used for controlling said controlled cooling.

During said controlled cooling by the liquid coolant, the coolant passes three phases of the quenching process. In the first phase, i.e. the vapor film phase, the temperature on the surface of the rail head is so high that the coolant evaporates rapidly, thus causing the formation of a thin insulating vapor film (Leidenfrost effect). This vapor film phase, i.a., is highly dependent on the vapor formation heat of the coolant, the surface condition of the track part, e.g. cinders, or the chemical composition and design of the cooling tank. In the second phase, the boiling phase, the coolant comes into direct contact with the hot surface of the rail head and immediately starts to boil, thus causing a high cooling speed. The third phase, the convection phase, starts as soon as the surface temperature of the track part has dropped to the boiling point of the coolant. In this range, the cooling speed is substantially influenced by the flow speed of the coolant.

The transition from the vapor film phase to the boiling phase usually takes place in a relatively uncontrolled and spontaneous manner. Since the rail temperature is subject to certain production-related temperature fluctuations over the entire length of the track part, the problem exists that the transition from the vapor film phase to the boiling phase occurs at different times in different longitudinal zones of the track part. This would lead to the formation of a non-uniform microstructure over the length of the track part, and hence to non-uniform material properties. In order to unify the time of the transition from the vapor film phase to the boiling phase over the entire rail length, a preferred mode of operation provides that during the third step a film-breaking, gaseous pressure medium such as nitrogen is supplied to the rail head along the entire length of the track part to break the vapor film along the entire length of the track part and initiate the boiling phase.

It may, in particular, be proceeded such that the condition of the coolant is monitored during the second and/or fourth steps along the entire length of the track part, and the film-breaking, gaseous pressure medium is supplied to the rail head as soon as the first occurrence of the boiling phase has been detected in a partial region of the track part length.

In a preferred manner, the film-breaking, gaseous pressure medium is supplied to the rail head about 20-100 s, in particular about 50 s, after the beginning of the second and/or fourth steps.

In the following, the invention will be explained in more detail by way of exemplary embodiments.

Example 1

In a first exemplary embodiment, a low-alloy steel having the following reference analysis was formed by hot-rolling to a running rail with a standard rail section:

0.3 wt % C
1.0 wt % Si
1.74 wt % Mn
0.31 wt % Cr
0.1 wt % Mo
0.014 wt % S
0.014 wt % P
20 ppm Al
70 ppm N Boron and titanium were not alloyed. Balance: iron and inadvertent accompanying elements.

Immediately upon leaving the rolling stand, the rail was subjected at rolling heat to controlled cooling. Said controlled cooling is explained in more detail below with reference to the time-temperature transformation diagram depicted in FIG. 1, wherein the line denoted by 1 represents the cooling course. In a first step, the rail is cooled to a temperature of 810° C. at ambient air. In a second step, the rail is immersed into the liquid coolant over its entire length and by its entire cross section, and a cooling rate of 4° C./s was adjusted. After about the rail was removed from the cooling bath, and an initial surface temperature of the rail head of 470° C. was measured, point 2 having been reached. During a period of about 45 s, the rail was held in a position removed from the coolant. Reheating to a temperature of 500° C. occurred within the first 5 seconds. When reaching point 3, the rail was again immersed into the cooling bath and cooled to 440° C. (point 4) at a cooling rate of 4° C./s. This temperature was held for 100 seconds. When reaching point 5, the rail was cooled to room temperature at ambient air.

The above-described controlled cooling resulted in a rail head having the following microstructure:

60-70 vol % carbide-free bainite,
8-13 vol % ferrite,
11-18 vol % austenite,
5-15 vol % martensite.

Figure 2:
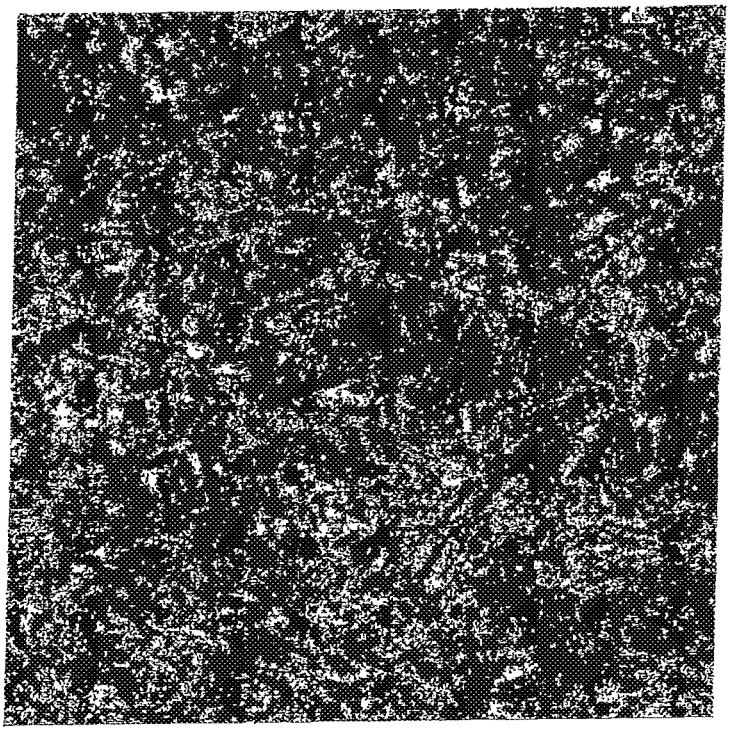
FIG. 2 shows the microstructure of the embodiment of Example 1.

The microstructure is illustrated in FIG. 2. The following material properties were measured:

0.2% yield stress: 750 MPa+10 MPa
Tensile strength: 1130 MPa+10 MPa
Ultimate elongation: 17%+1%
Surface hardness: 330 HB+5 HB
Fracture toughness $K_{Ic}$ on standard sample at room temperature: 58 MPa $\sqrt{m}$±3 MPa $\sqrt{m}$

Example 2

In a second exemplary embodiment, a low-alloy steel having the following reference analysis was formed by hot-rolling to a running rail with a standard rail section:

0.5 wt % C
1.1 wt % Si
1.5 wt % Mn
0.7 wt % Cr
0.01 wt % Mo
0.20 wt % V
0.014 wt % S
0.014 wt % P
20 ppm Al
70 ppm N
Balance: Fe and inadvertent accompanying elements.

The heat treatment was performed as in Example 1.

In order to raise the wear resistance relative to that of Example 1 (0.3 wt % C), yet, at the same time, maintain the break resistance, a material having a significantly higher carbon content (0.5 wt %) was used in Example 2.

The advantage of a higher carbon content resides in enabling an enhanced enrichment both in the austenite and in the martensite, thus strengthening these two microstructural components, which has a very positive effect on the wear resistance. The heat treatment (accelerated cooling), due to the higher carbon content, reduces the increased inclination to perlite formation—i.e. the region where perlite formation takes place is passed through very quickly such that no significant amounts of perlite can precipitate on the rail head surface (as far as to a depth of 10 mm). This means that the microstructure continues to comprise the previously indicated microstructural components.

The following material properties were measured:

0.2% yield stress: 900 MPa+10 MPa

Tensile strength: 1320 MPa+10 MPa
Ultimate elongation: 13%+1%
Surface hardness: 380 HB+5 HB
Fracture toughness $K_{Ic}$ on standard sample at room temperature: 53 MPa √m±3 MPa √m

The invention claimed is:

1. A track part comprising a low-alloy steel rail, wherein the steel comprises, in the rail head of the track part, a ferrite portion of 5-15 vol %, an austenite portion of 5-20 vol %, a martensite portion of 5-20 vol %, and a portion of carbide-free bainite of 55-75 vol %, wherein the low-alloy steel further comprises alloying components in the following amounts:

0.28-0.32 wt-% C;
0.98-1.03 wt-% Si;
1.7-1.8 wt-% Mn;
0.28-0.32 wt-% Cr;
0.08-0.13 wt-% Mo, and optionally;
0.01-0.25 wt-% V;
0.01-0.016 wt-% P;
0.01-0.016 wt-% S; and
balance: iron;

wherein the track part has a hardness of 320-400 HB in the head region and the amount of Cr prevents the occurrence of chromium carbides and facilitates weldability.

2. The track part according to claim 1, characterized in that the portion of the carbide-free bainite is 60-70 vol %.

3. The track part according to claim 1, characterized in that the ferrite portion is 8-13 vol %.

4. The track part according to claim 1, characterized in that the bainite forms a matrix in which austenite, martensite and ferrite are homogenously distributed.

5. The track part according to claim 1, characterized in that the austenite portion and the martensite portion are at least partially present in island form.

6. The track part according to claim 1, characterized in that the track part has a tensile strength $R_m$ of 1050-1400 $N/mm^2$ in the head region.

7. A method for producing a track part according to claim 1 from a hot-rolled section, characterized in that the rail head of the hot-rolled section, immediately after having left the rolling stand, is subjected at rolling heat to controlled cooling, said controlled cooling comprising in a first step cooling at ambient air until reaching a first temperature of 780-830° C., in a second step accelerated cooling to a second temperature of 450-520° C., in a third step holding the second temperature, in a fourth step further accelerated cooling until reaching a third temperature of 420-470° C., in a fifth step holding the third temperature, and in a sixth step cooling to room temperature at ambient air.

8. The method according to claim 7, characterized in that said accelerated cooling in the second step is performed at a cooling rate of 2-5° C./s.

9. The method according to claim 7, characterized in that the third step extends over a period of 10-300 s.

10. The method according to claim 7, characterized in that said accelerated cooling in the fourth step is performed at a cooling rate of 2-5° C./s.

11. The method according to claim 7, characterized in that the fifth step extends over a period of 50-600 s.

12. The method according to claim 7, characterized in that reheating takes place during the third and/or the fifth steps.

13. The method according to claim 7, characterized in that the temperature is detected at a plurality of measuring points distributed over the length of the track part and a mean value of the temperature is formed, which is used for controlling said controlled cooling.

14. The method according to claim 7, characterized in that said controlled cooling is performed by immersing at least the rail head into a liquid coolant.

15. The method according to claim 7, characterized in that cooling during the second or fourth step is controlled such that the coolant initially forms a vapour film on the surface of the rail head and subsequently boils on the surface.

16. The method according to claim 15, characterized in that during the second and/or fourth step a film-breaking, gaseous pressure medium such as nitrogen is supplied to the rail head along the entire length of the track part to break the vapor film along the entire length of the track part and initiate the boiling phase.

17. The method according to claim 16, characterized in that the condition of the coolant is monitored during the second and/or fourth steps along the entire length of the track part and the film-breaking, gaseous pressure medium is supplied to the rail head as soon as the first occurrence of the boiling phase has been detected in a partial region of the track part length.

18. The method according to claim 16, characterized in that the film-breaking, gaseous pressure medium is supplied to the rail head about 20-100 s after the beginning of the second and/or fourth steps.

19. The method according to claim 7, characterized in that the track part is completely immersed into the coolant during the second step.

20. The method according to claim 7, characterized in that the track part is held in a position removed from the coolant during the third and/or fifth steps.

21. The method according to claim 7, characterized in that, during the fourth step, the track part is immersed into the coolant only with the rail head.

* * * * *